US010604385B2

(12) United States Patent
Masuda

(10) Patent No.: US 10,604,385 B2
(45) Date of Patent: Mar. 31, 2020

(54) CRANE

(71) Applicant: TADANO LTD., Kagawa (JP)

(72) Inventor: Naotaka Masuda, Kagawa (JP)

(73) Assignee: TADANO LTD., Kagawa (JP)

( * ) Notice: Subject to any disclaimer, the term of this patent is extended or adjusted under 35 U.S.C. 154(b) by 0 days.

(21) Appl. No.: 16/088,542

(22) PCT Filed: Apr. 7, 2017

(86) PCT No.: PCT/JP2017/014559
§ 371 (c)(1),
(2) Date: Sep. 26, 2018

(87) PCT Pub. No.: WO2017/175865
PCT Pub. Date: Oct. 12, 2017

(65) Prior Publication Data

US 2019/0106301 A1 Apr. 11, 2019

(30) Foreign Application Priority Data

Apr. 8, 2016 (JP) ..... 2016-078498

(51) Int. Cl.
*B66C 13/20* (2006.01)
*B66C 13/56* (2006.01)
(Continued)

(52) U.S. Cl.
CPC ..... *B66C 13/20* (2013.01); *B66C 13/56* (2013.01); *B66C 23/54* (2013.01); *B66C 23/86* (2013.01);
(Continued)

(58) Field of Classification Search
CPC ..... B66C 23/86; B66C 25/54; F15B 11/042; F15B 11/044; F15B 13/04
See application file for complete search history.

(56) References Cited

U.S. PATENT DOCUMENTS 5,636,516 A * 6/1997 Kon ..... E02F 9/123 60/466
6,244,158 B1 * 6/2001 Roche ..... F15B 11/044 91/446
(Continued)

FOREIGN PATENT DOCUMENTS

DE 102006040459 A1 * 3/2007 ..... B66C 13/18
JP 3948122 B2 7/2007
(Continued)

OTHER PUBLICATIONS

Jul. 4, 2017, International Search Report issued for related PCT application No. PCT/JP2017/014559.
(Continued)

*Primary Examiner* — Thomas E Lazo
*Assistant Examiner* — Matthew Wiblin
(74) *Attorney, Agent, or Firm* — Paratus Law Group, PLLC

(57) ABSTRACT

The present invention is configured so that it is possible to select any one of a first mode in which a first adjustment valve 13 and a second adjustment valve 20 operate solely on the basis of manipulation of a main manipulation tool (turning lever 8*i*), a second mode in which the first adjustment valve 13 operates solely on the basis of manipulation of the main manipulation tool (8*i*) and the second adjustment valve 20 operates solely on the basis of manipulation of a secondary manipulation tool (brake pedal 8*j*), and a third mode in which the first adjustment valve 13 operates solely on the basis of manipulation of the main manipulation tool (8*i*) and the second adjustment valve 20 operates on the basis of manipulation of the secondary manipulation tool (8*j*) while operating on the basis of manipulation of the main manipulation tool (8*i*).

4 Claims, 8 Drawing Sheets

(51) Int. Cl.

| | |
|---|---|
| ***B66C 23/86*** | (2006.01) |
| ***F15B 11/042*** | (2006.01) |
| ***F15B 11/044*** | (2006.01) |
| ***B66C 23/00*** | (2006.01) |

(52) U.S. Cl.
CPC ..... *F15B 11/042* (2013.01); *F15B 11/044* (2013.01); *B66C 2700/0371* (2013.01); *F15B 2211/455* (2013.01); *F15B 2211/46* (2013.01)

(56) References Cited

U.S. PATENT DOCUMENTS 6,457,487 B1 * 10/2002 Stephenson ..... F15B 11/042 137/596.16
10,150,657 B2 * 12/2018 Miyoshi ..... B66C 13/16
2005/0146252 A1 * 7/2005 Chuang ..... F15B 11/042 312/223.2
2010/0263364 A1 10/2010 Tsutsui et al.
2010/0264106 A1 * 10/2010 Kawai ..... B66C 23/86 212/276
2010/0313555 A1 * 12/2010 Jene ..... F15B 11/044 60/444
2013/0213026 A1 * 8/2013 Yamamoto ..... B66C 23/86 60/327

FOREIGN PATENT DOCUMENTS

JP 2010-247965 A 11/2010
JP 2015-009939 A 1/2015

OTHER PUBLICATIONS

Jul. 4, 2017, International Search Opinion issued for related PCT application No. PCT/JP2017/014559.

* cited by examiner

CRANE

CROSS REFERENCE TO PRIOR APPLICATION

This application is a National Stage Patent Application of PCT International Patent Application No. PCT/JP2017/014559 (filed on Apr. 7, 2017) under 35 U.S.C. § 371, which claims priority to Japanese Patent Application No. 2016-078498 (filed on Apr. 8, 2016), which are all hereby incorporated by reference in their entirety.

TECHNICAL FIELD

The present invention relates to a crane. Specifically, the present invention relates to a crane that includes a swivel apparatus.

BACKGROUND ART

Conventionally, a crane that hoists and carries a load has been known (see PTL 1). The crane includes a swivel apparatus that mainly includes a hydraulic motor. A boom is freely swivelable with respect to a traveling body.

A technique has been proposed that independently controls the flow rate of hydraulic fluid to be delivered to a hydraulic device (also called "meter in-flow rate") and the flow rate of hydraulic fluid returned from the hydraulic device, and facilitates achievement of stability and responsiveness in a compatible manner (see PTL 2). Unfortunately, a possible case of a configuration allowing a single operation tool (lever or the like) to adjust the meter in-flow rate and the meter out-flow rate uniquely defines maneuvering characteristics accordingly. Consequently, even if such a technique is applied to the swivel apparatus, it is believed to be difficult to achieve fine maneuvering characteristics.

On the contrary, in a possible case of a configuration that includes two operation tools and allows the first operation tool to adjust the meter in-flow rate while allowing the second operation tool to adjust the meter out-flow rate, it is believed that fine maneuvering characteristics can be achieved. This is because reduction in meter out-flow rate can apply a braking force to the swivel operation due to inertia, and the swivel operation can be performed with an appropriate braking force being applied. However, such a maneuvering form must be more complicated than the conventional maneuvering form that performs the swivel operation through a single operation tool. Accordingly, a crane has been needed that can select one maneuvering form from among maneuvering forms including the conventional maneuvering form, and is capable of achieving fine maneuvering characteristics for other maneuvering forms except the conventional maneuvering form.

CITATION LIST

Patent Literature

PTL 1
Japanese Patent Application Laid-Open No. 2015-9939
PTL 2
Japanese Patent No. 3948122

SUMMARY OF INVENTION

Technical Problem

A crane is provided that can select one maneuvering form from among maneuvering forms including the conventional maneuvering form, and is capable of achieving fine maneuvering characteristics for other maneuvering forms except the conventional maneuvering form.

Solution to Problem

A first invention is directed to a crane, including:

a first adjustment valve;

a second adjustment valve; and a hydraulic motor used for a swivel operation, the first adjustment valve being freely adjustable in a flow rate of hydraulic fluid to be delivered to the hydraulic motor, the second adjustment valve being freely adjustable in a flow rate of hydraulic fluid returned from the hydraulic motor, the crane further including:

a controller capable of controlling the first adjustment valve and the second adjustment valve;

a main operation tool allowing tar inputting an instruction pertaining to the swivel operation into the controller; and a sub-operation tool allowing for inputting an instruction pertaining to the swivel operation into the controller, in which the crane allows for selecting any one of:

a first mode, in which the first adjustment valve and the second adjustment valve are actuated based only on an operation of the main operation tool;

a second mode, in which the first adjustment valve is actuated based only on an operation of the main operation tool, and the second adjustment valve is actuated based only on an operation of the sub-operation tool; and a third mode, in which the first adjustment valve is actuated based only on an operation of the main operation tool, and the second adjustment valve is actuated based on an operation of the main operation tool while being also actuated based on an operation of the sub-operation tool.

A second invention is directed to the crane according to the first invention, wherein when the first mode is selected, the first adjustment valve and the second adjustment valve increase the respective flow rates with increase in an amount of operation of the main operation tool, and reduce the respective flow rates with reduction in the amount of operation of the main operation tool.

A third invention is directed to the crane according to the first invention, wherein when the second mode is selected, the first adjustment valve increases the flow rate with increase in an amount of operation of the main operation tool, and reduces the flow rate with reduction in the amount of operation of the main operation tool, and the second adjustment valve reduces the flow rate with increase in an amount of operation of the sub-operation tool, and increases the flow rate with reduction in the amount of operation of the sub-operation tool.

A fourth invention is directed to the crane according to the first invention, wherein when the third mode is selected, the first adjustment valve and the second adjustment valve increase the respective flow rates with increase in an amount of operation of the main operation tool, and reduce the respective flow rates with reduction in the amount of operation of the main operation tool, and the second adjustment valve reduces the flow rate to be less than a flow rate according to the amount of operation of the main operation tool with increase in an amount of operation of the sub-operation tool, and increases the flow rate to the flow rate according to the amount of operation of the main operation tool with reduction in the amount of operation of the sub-operation tool.

Advantageous Effects of Invention

In the crane 1 according to the first invention, the first adjustment valve can freely adjust the flow rate of the hydraulic fluid to be delivered to the hydraulic motor, and the second adjustment valve can freely adjust the flow rate of the hydraulic fluid returned from the hydraulic motor. This crane 1 can select any one of first to third modes. In the "first mode", the first adjustment valve and the second adjustment valve are actuated based only on an operation of the main operation tool. In the "second mode", the first adjustment valve is actuated based only on an operation of the main operation tool, and the second adjustment valve is actuated based only on an operation of the sub-operation tool. In the "third mode", the first adjustment valve is actuated based only on an operation of the main operation tool, and the second adjustment valve is actuated based on an operation of the main operation tool while being also actuated based on an operation of the sub-operation tool. Such a crane can select one maneuvering form from among the three maneuvering forms including the conventional maneuvering form. When the "second mode" or "third mode" is selected, fine maneuvering characteristics can be achieved.

The crane according to the second invention specifically limits the crane according to the first invention. That is, when the "first mode" is selected, the first adjustment valve and the second adjustment valve increase the respective flow rates with increase in the amount of operation of the main operation tool, and reduce the respective flow rates with reduction in the amount of operation of the main operation tool. Consequently, when the "first mode" is selected, the conventional maneuvering form allowing the swivel operation to be performed through the single operation tool (swivel lever) is achieved. Accordingly, compatibility between the maneuvering forms can be facilitated.

The crane according to the third invention specifically limits the crane according to the first invention. That is, when the "second mode" is selected, the first adjustment valve increases the flow rate with increase in the amount of operation of the main operation tool, and reduces the flow rate with reduction in the amount of operation of the main operation tool. The second adjustment valve reduces the flow rate with increase in the amount of operation of the sub-operation tool, and increases the flow rate with reduction in the amount of operation of the sub-operation tool. Consequently, when the "second mode" is selected, the braking force can be applied by, for example, reducing the flow rate at the second adjustment valve (meter out-flow rate) with respect to the flow rate at first adjustment valve (meter-flow rate), thereby allowing the maneuvering characteristics to be finely achieved.

The crane according to the fourth invention specifically limits the crane according to the first invention. That is, when the "third mode" is selected, the first adjustment valve and the second adjustment valve increase the respective flow rates with increase in the amount of operation of the main operation tool, and reduce the respective flow rates with reduction in the amount of operation of the main operation tool. The second adjustment valve reduces the flow rate to be less than a flow rate according to the amount of operation of the main operation tool with increase in an amount of operation of the sub-operation tool, and increases the flow rate to the flow rate according to the amount of operation of the main operation tool with reduction in the amount of operation of the sub-operation tool. Consequently, when the "third mode" is selected, even though the conventional maneuvering form performing the swivel operation through the single operation tool (swivel lever) is still adopted, the braking force can be applied by, for example, reducing the flow rate at second adjustment valve (meter out-flow rate) with respect to the flow rate at first adjustment valve meter in-flow rate), thereby allowing fine maneuvering characteristics to be achieved.

DESCRIPTION OF EMBODIMENTS

The technical thought of the present invention is applicable not only to crane 1 described below but also to other cranes.

First, crane 1 is briefly described.

Figure 1:
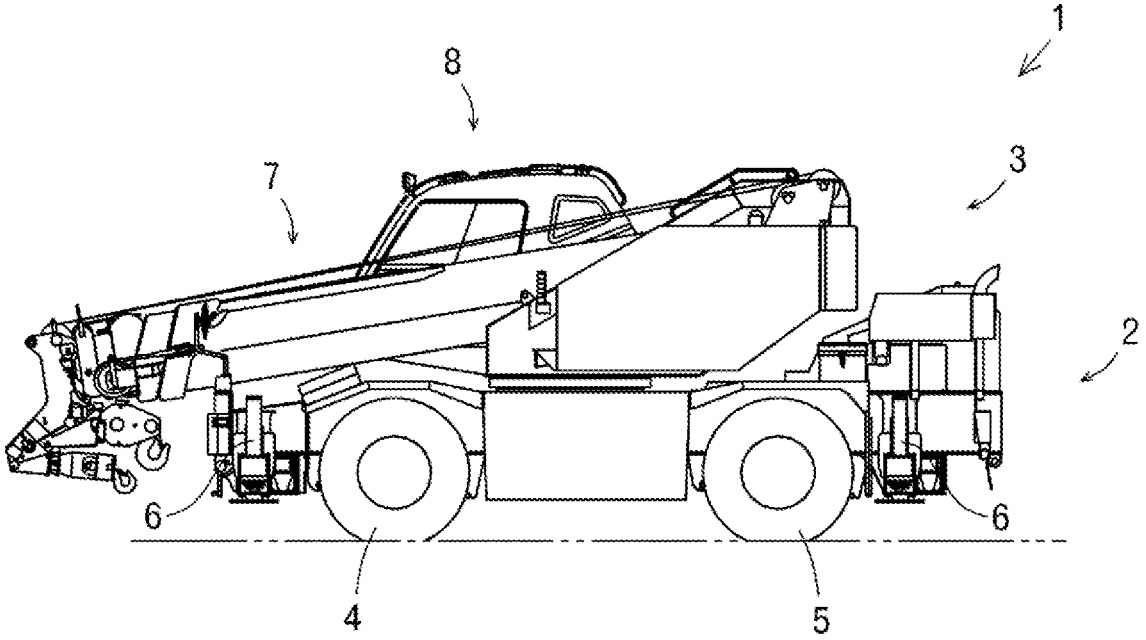
FIG. 1 illustrates a crane during traveling.
Figure 2:
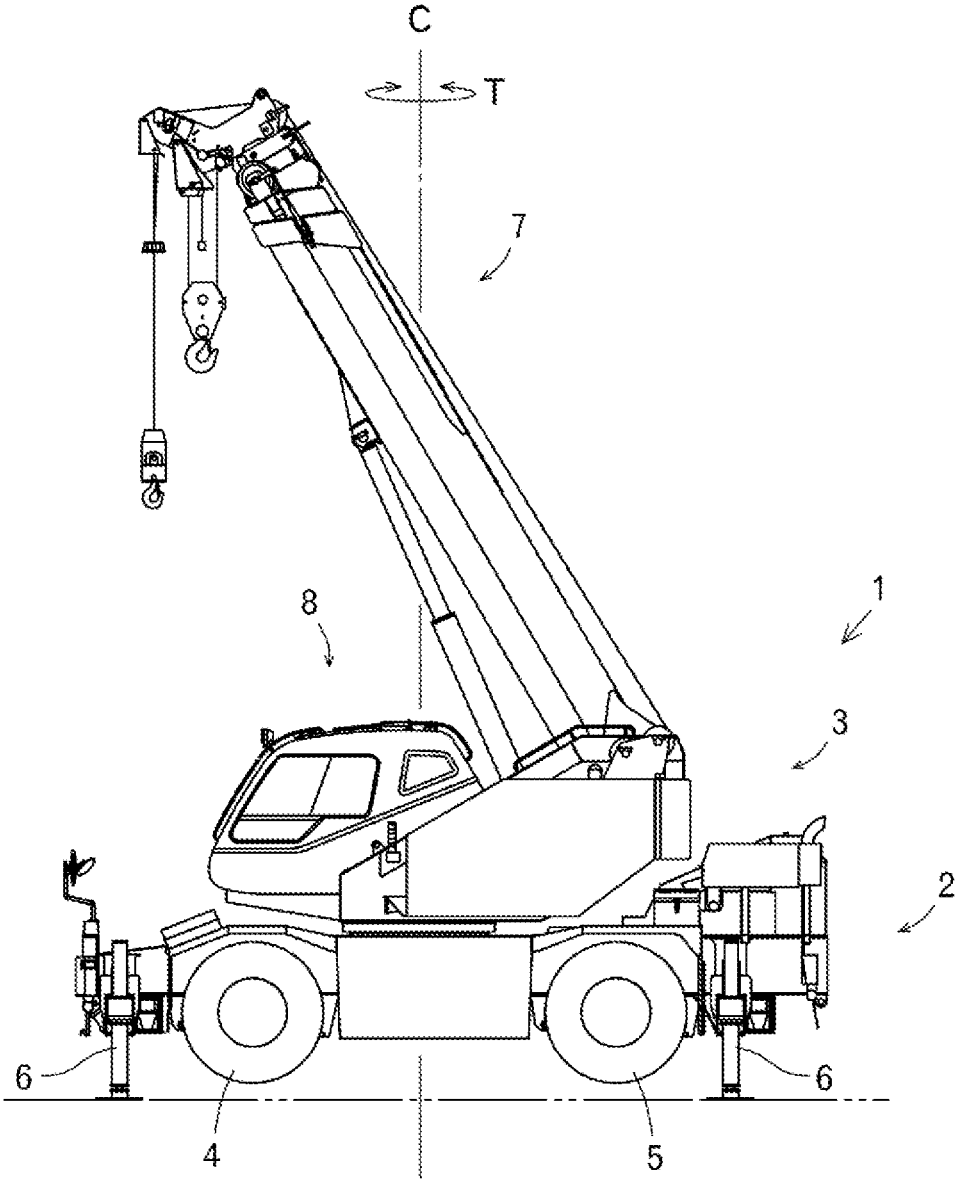
FIG. 2 illustrates the crane during a hoisting operation.
Figure 3:
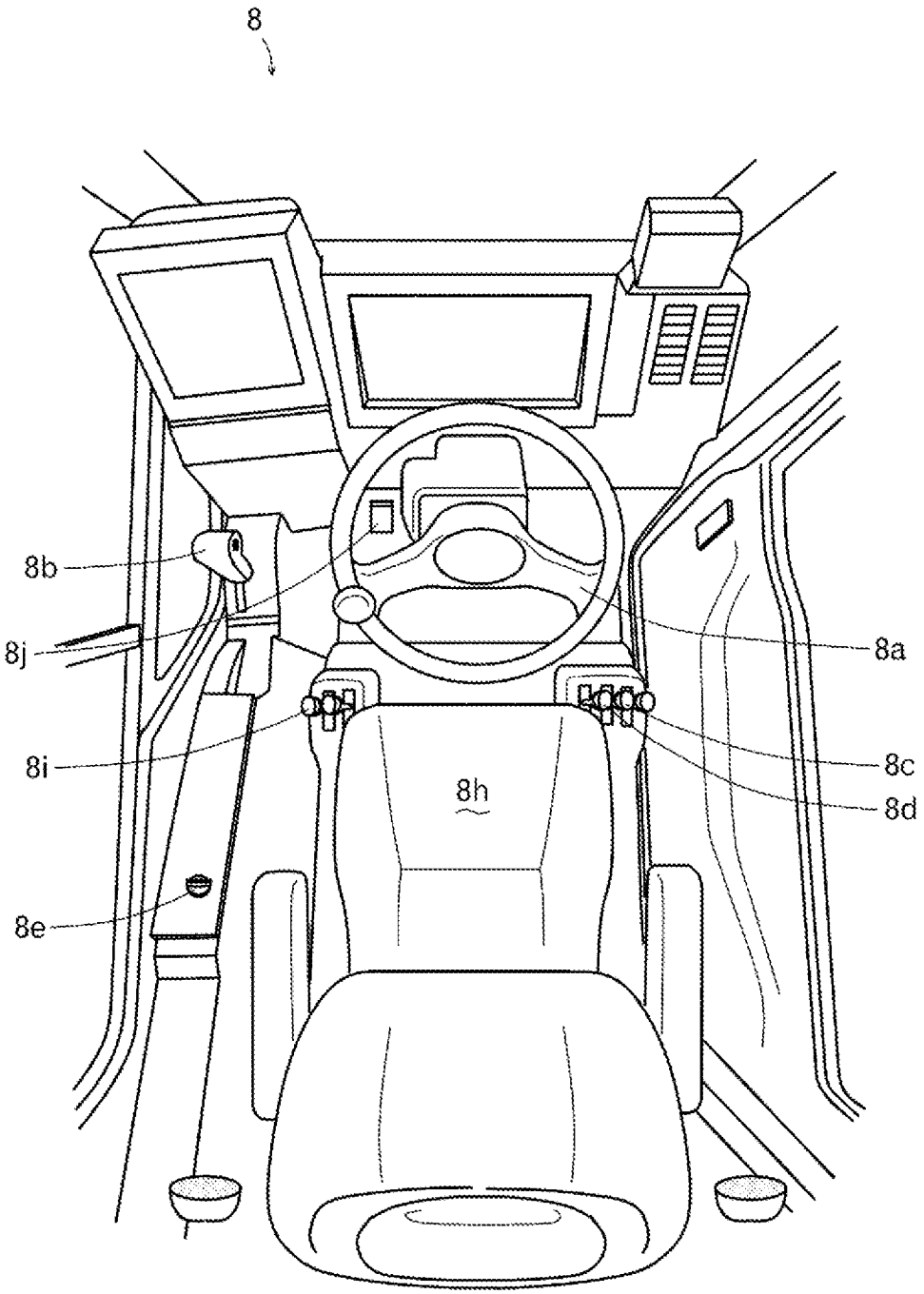
FIG. 3 illustrates the inside of a cabin.

FIG. 1 illustrates crane 1 during traveling, FIG. 2 illustrates crane 1 during a hoisting operation. FIG. 3 illustrates the inside of cabin 8.

Crane 1 mainly includes traveling body 2, and swivel body 3.

Traveling body 2 includes a lateral pair of front tires 4, and a lateral pair of rear tires 5. Furthermore, traveling body 2 includes outriggers 6 that are brought in contact with the ground and facilitates stabilization during the hoisting operation. Moreover, traveling body 2 includes not only hydraulic actuators for driving these elements but also an engine, a transmission and the like.

Swivel body 3 includes boom 7 so as to protrude forward from the rear. Boom 7 can be freely derricked by the hydraulic actuator, and can freely expand and contract in a multistage manner. Boom 7 is freely rotatable centered at rotation axis C (see arrow T). Swivel body 3 further includes cabin 8 disposed to the right of boom 7. In cabin 8, not only steering wheel 8*a* and shift lever 8*b* that are required for a traveling operation, but also lifting and lowering levers 8*c* and 8*d* that are required for an operation of the hoisting operation are disposed. In this crane 1, selector switch 8*e* is disposed for switching maneuvering forms.

Next, selector switch 8*e* is described.

Figure 4:
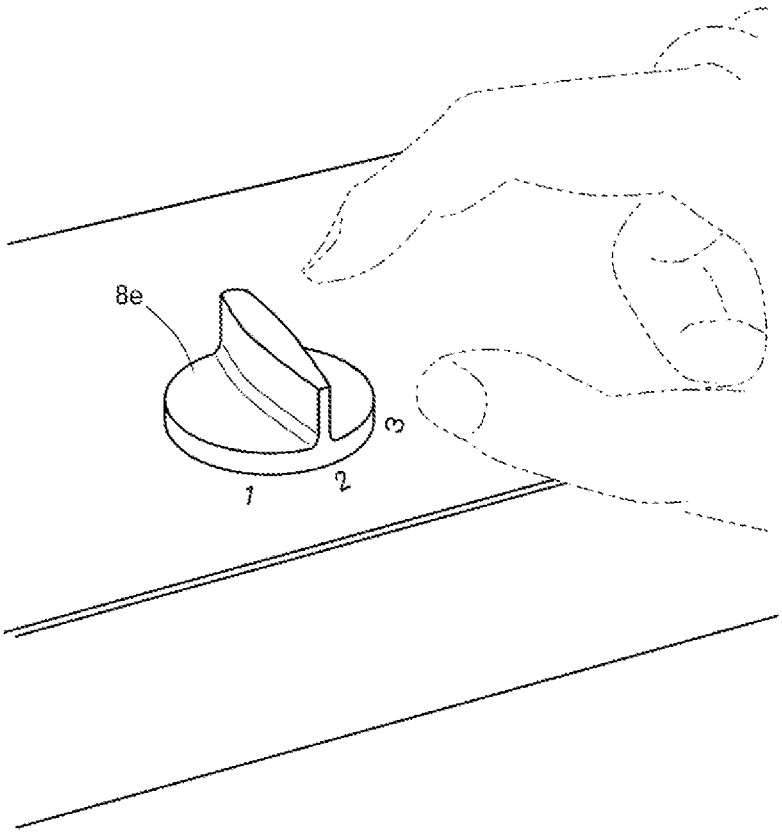
FIG. 4 illustrates a selector switch.

FIG. 4 illustrates selector switch 8*e*. Selector switch 8*e* is disposed to the left of seat 8*h* so that an operator can easily perform operations, with the operator being seated (see FIG. 3).

Selector switch 8*e* is typically called a dial switch or a rotary switch. The operator grabs selector switch 8*e* and changes the switch to "1", which can select a "first mode" as the maneuvering form. The operator grabs selector switch 8*e* and changes the switch to "2", which can select a "second mode" as the maneuvering form. The operator grabs selector switch 8*e* and changes the switch to "3", which can select a "third anode" as the maneuvering form. The details of each mode are described later.

As described above, in this crane 1, selector switch 8*e* is disposed to the left of seat 8*h*. Alternatively, this switch may be disposed at another place. In this crane 1, selector switch 8*e* is the dial switch (rotary switch). Alternatively, this switch may have another form. For example, this switch may have a shape of a seesaw switch. Alternatively, this switch may be displayed on a touch panel.

Next, swivel apparatus M that allows boom 7 to be swiveled is described. Note that swivel apparatus M described below is an apparatus greatly simplified for the sake of simplicity.

Figure 5:
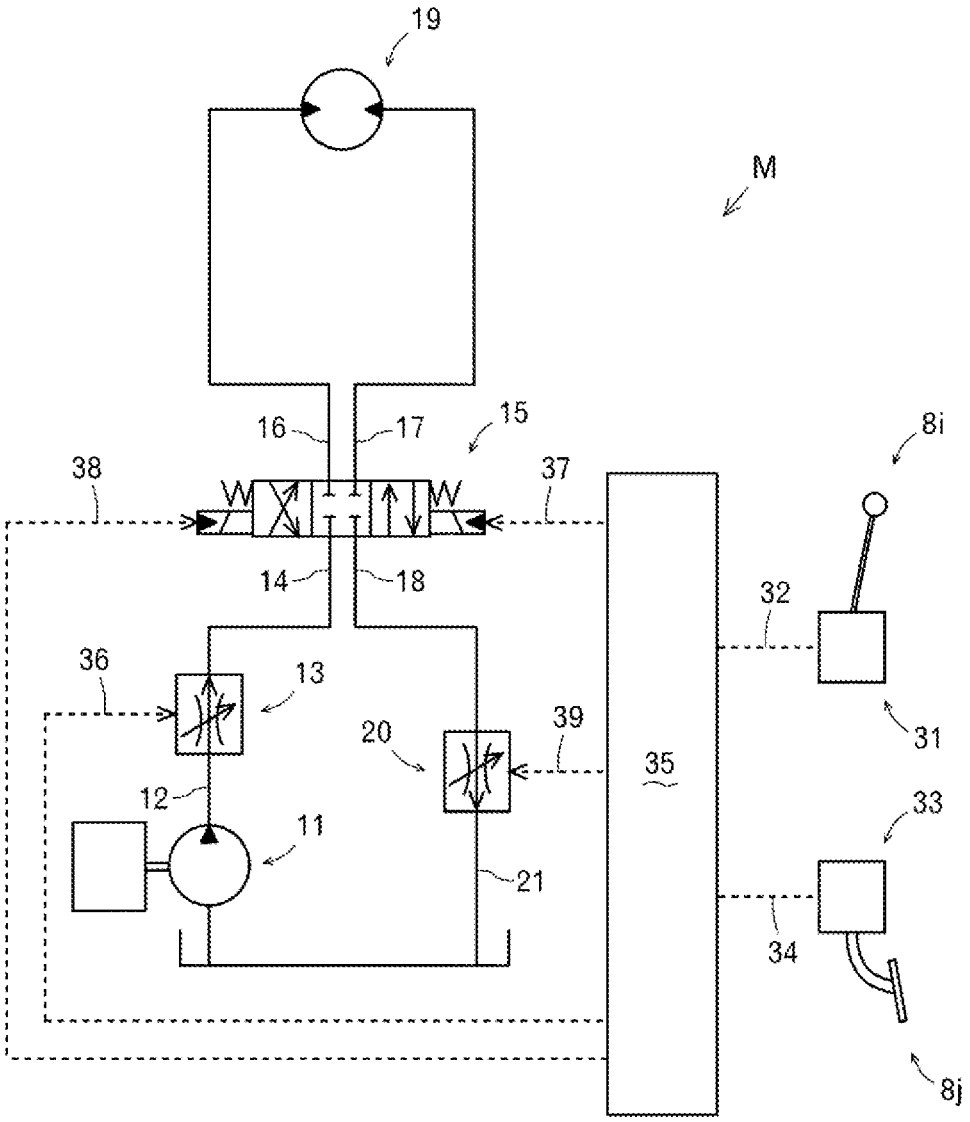
FIG. 5 illustrates a configuration of a swivel apparatus.

FIG. 5 illustrates the configuration of swivel apparatus M. Solid lines in the diagram represent a hydraulic circuit. Broken lines in the diagram represent an electric circuit.

First, the hydraulic circuit is described.

Hydraulic pump 11 is disposed in the hydraulic circuit. Hydraulic fluid pipe 12 communicates with hydraulic pump 11.

Furthermore, first adjustment valve 13 is disposed in the hydraulic circuit. Hydraulic fluid pipe 12 communicates with first adjustment valve 13. Accordingly, the hydraulic fluid pumped out from hydraulic pump 11 is supplied to first adjustment valve 13 through hydraulic fluid pipe 12. First adjustment valve 13 is actuated on the basis of a signal from controller 35 described later. This valve adjusts the passing flow rate, that is, meter in-flow rate Mi, in a manner proportional to a signal value (current value), (see FIGS. 6A and 6B to 8A and 8B). Hydraulic fluid pipe 14 communicates with first adjustment valve 13.

Furthermore, direction switching valve 15 is disposed in the hydraulic circuit Hydraulic fluid pipe 14 communicates with direction switching valve 15. Accordingly, the hydraulic fluid pumped out from hydraulic pump 11 is supplied to direction switching valve 15 through hydraulic fluid pipes 12 and 14. Hydraulic fluid pipes 16, 17 and 18 communicate with direction switching valve 15. Accordingly, actuation in one direction allows the hydraulic fluid to flow into hydraulic fluid pipe 16, while actuation in the other direction allows the hydraulic fluid to flow into hydraulic fluid pipe 17. In all the cases, the hydraulic fluid is discharged through hydraulic fluid pipe 18.

Furthermore, hydraulic motor 19 is disposed in the hydraulic circuit. Hydraulic fluid pipes 16 and 17 communicate with hydraulic motor 19. Accordingly, the hydraulic fluid pumped out from hydraulic pump 11 is supplied to hydraulic motor 19 through hydraulic fluid pipes 12, 14 and 16 or hydraulic fluid pipes 12, 14 and 17. When the hydraulic fluid is supplied through hydraulic fluid pipes 12, 14 and 16, hydraulic motor 19 rotates in one direction. When the hydraulic fluid is supplied through hydraulic fluid pipes 12, 14 and 17, this motor rotates in the other direction. Hydraulic motor 19 is coupled to swivel body 3 via a structure, not illustrated. Consequently, when hydraulic motor 19 rotates in the one direction, swivel body 3 rotates in the one direction accordingly. In turn, boom 7 also rotates in the one direction. On the contrary, when hydraulic motor 19 rotates in the other direction, swivel body 3 rotates in the other direction accordingly. In turn, boom 7 also rotates in the other direction.

Furthermore, second adjustment valve 20 is disposed in the hydraulic circuit. Hydraulic fluid pipe 18 communicates with second adjustment valve 20. Accordingly, the hydraulic fluid pumped out from hydraulic pump 11 is supplied to second adjustment valve 20 through hydraulic fluid pipes 12, 14, 16, 17 and 18. Second adjustment valve 20 is actuated on the basis of a signal from controller 35 described later. This valve adjusts the passing flow rate, that is, meter out-flow rate Mo, in a manner proportional to a signal value (current value) (see FIGS. 6A and 6B to 8A and 8B). Hydraulic fluid pipe 21 communicates with second adjustment valve 20.

As described above, swivel apparatus M of this crane 1 has the configuration where first adjustment valve 13 adjusts meter in-flow rate Mi, and second adjustment valve 20 adjusts meter out-flow rate Mo. Alternatively, a configuration may be adopted where direction switching valve 15 is replaced with flow adjustment and direction switching valve. Specifically, it may be configured that first adjustment valve 13 is not included, and meter in-flow rate Mi is adjusted by the flow adjustment and direction switching valve. Alternatively, it may be configured that second adjustment valve 20 is not included, and meter out-flow rate Mo is adjusted by the flow adjustment and direction switching valve.

Next, the electric circuit for transmitting an electric signal is described.

Position sensor 31 is disposed in the electric circuit. Electric wire 32 is connected to position sensor 31. Position sensor 31 is attached to swivel lever 8*i* that is a main operation tool. Accordingly, position sensor 31 can detect the inclined angle of swivel ever 8*i*, that is, the amount of operation.

Furthermore, position sensor 33 is disposed in the electric circuit. Electric wire 34 is connected to position sensor 33. Position sensor 33 is attached to brake pedal 8*j* that is a sub-operation tool. Accordingly, position sensor 33 can detect the pressed angle of brake pedal 8*j*, that is, the amount of operation.

Furthermore, controller 35 is disposed in the electric circuit. Electric wires 32 and 34 are connected to controller 35. Accordingly, controller 35 can recognize the amount of operation of swivel lever 8*i*, and the amount of operation of brake pedal 8*j*. Multiple electric wires 36, 37, 38 and 39 are connected to controller 35. These electric wires 36, 37, 38 and 39 are connected to first adjustment valve 13, direction switching valve 15, and second adjustment valve 20. Accordingly, controller 35 can appropriately control these valves 13, 15 and 20.

Hereinafter, the aforementioned modes are each described.

Here, the specifications of first adjustment valve 13 and second adjustment valve 20 are briefly described.

First adjustment valve 13 adjusts meter in-flow rate Mi. When a spool included in first adjustment valve 13 is slid, a port hole and a port hole communicate with each other, thereby allowing first adjustment valve 13 to serve as a path for the hydraulic fluid. The path area is designed to become large substantially proportional to the sliding distance (amount of stroke) of the spool. That is, the amount of stroke of the spool and the path area for the hydraulic fluid substantially have a proportional relationship.

Meanwhile, second adjustment valve 20 adjusts meter out-flow rate Mo. When a spool included in second adjustment valve 20 is slid, a port hole and a port hole communicate with each other, thereby allowing second adjustment valve 20 to serve as a path for the hydraulic fluid. The path area is designed to become large substantially proportional to the sliding distance (amount of stroke) of the spool. That is, the amount of stroke of the spool and the path area for the hydraulic fluid substantially have a proportional relationship.

First, the "first mode" that is a first maneuvering form is described.

Figure 6A:
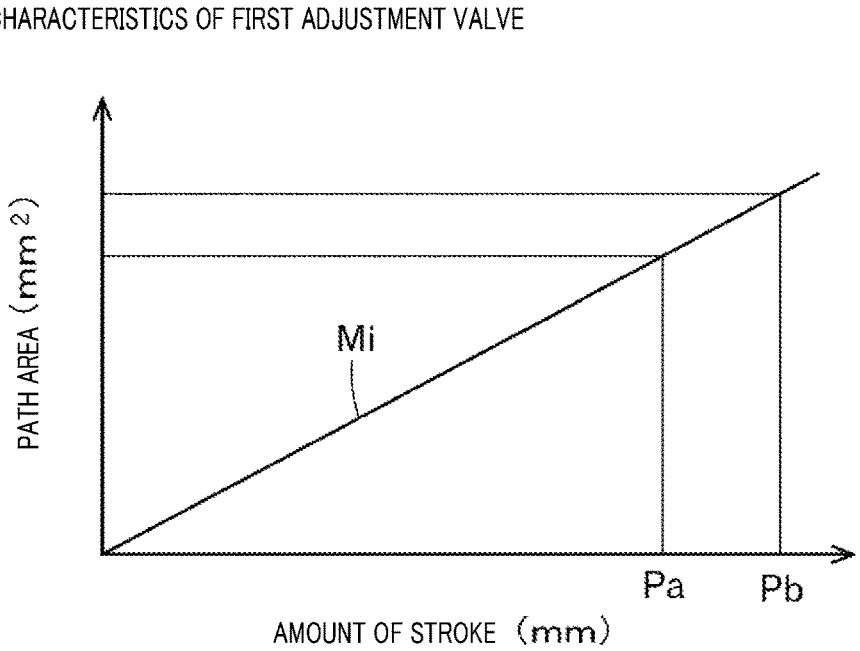
FIGS. 6A and 6B illustrate operation forms of adjustment valves in a first mode.
Figure 6B:
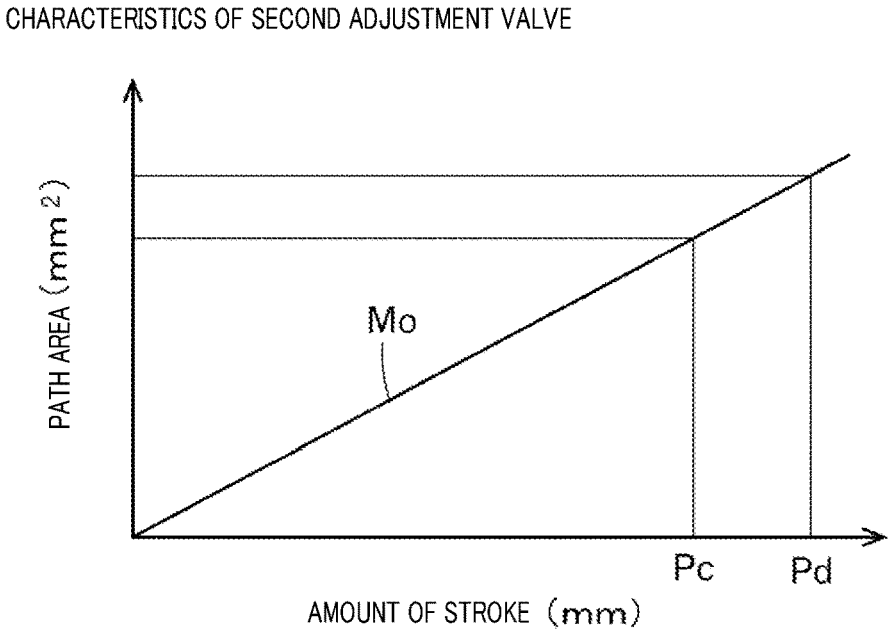

FIGS. 6A and 6B illustrate the operation forms of adjustment valves 13 and 20 in the first mode, FIG. 6A illustrates the operation form of first adjustment valve 13. FIG. 6B illustrates the operation form of second adjustment valve 20.

In the "first mode", first adjustment valve 13 and second adjustment valve 20 are actuated based only on the operation of swivel lever 8*i*. In the "first mode", even if brake pedal 8*j* is pressed, controls of adjustment valves 13 and 20 are not affected.

When the operator performs an operation of tilting swivel lever 8*i* in a state where the "first mode" is selected, controller 35 recognizes the amount of operation of swivel lever 8*i*. Controller 35 then controls first adjustment valve 13 according to the amount of operation. Specifically, the spool is slid according to the amount of operation (position Pa→position Pb). Accordingly, the path area is increased, and meter in-flow rate Mi is increased. At the same time, controller 35 also controls second adjustment valve 20 according to the amount of operation. Specifically, the spool is slid according to the amount of operation (position Pc→position Pd). Accordingly, the path area is increased, and meter out-flow rate Mo is increased.

On the contrary, when the operator performs an operation of raising swivel lever 8*i*, controller 35 recognizes the amount of operation of swivel lever 8*i*. Controller 35 then controls first adjustment valve 13 according to the amount of operation. Specifically, the spool is slid according to the amount of operation (position Ph→position Pa). Accordingly, the path area is reduced, and meter in-flow rate Mi is reduced. At the same time, controller 35 also controls second adjustment valve 20 according to the amount of operation. Specifically, the spool is slid according to the amount of operation (position Pd→position Pc). Accordingly, the path area is reduced, and meter out-flow rate Mo is reduced.

As described above, when the "first mode" is selected, first adjustment valve 13 and second adjustment valve 20 increase the respective flow rates with increase in the amount of operation of the main operation tool (swivel lever 8*i*), and reduce the respective flow rates with reduction in the amount of operation of the main operation tool (swivel lever 8*i*). Consequently, when the "first mode" is selected, the conventional maneuvering form allowing the swivel operation to be performed through the single operation tool (swivel lever 8*i*) is achieved. Accordingly, compatibility between the maneuvering forms can be facilitated.

Next, the "second mode" that is a second maneuvering form is described.

Figure 7A:
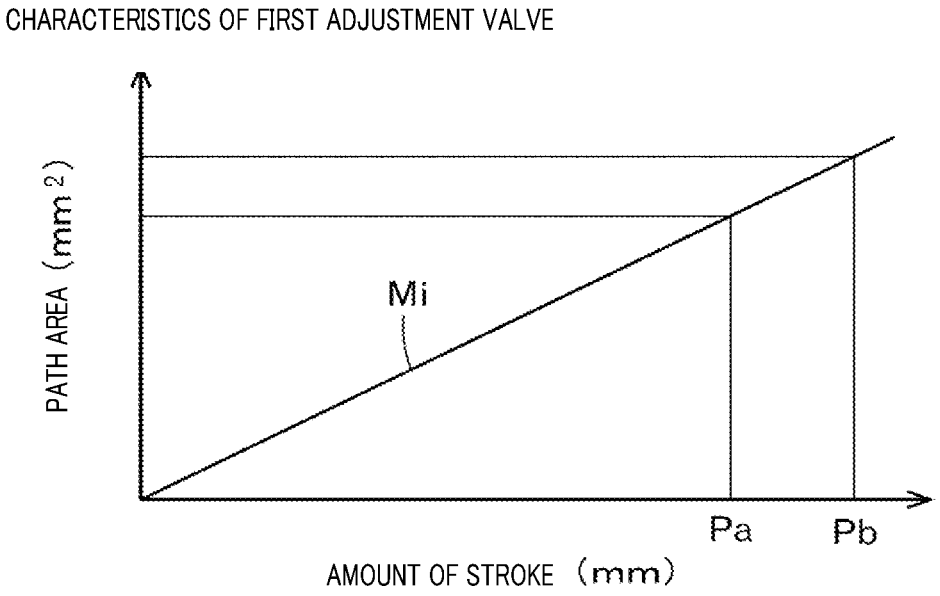
FIGS. 7A and 7B illustrate operation forms of adjustment valves in a second mode.
Figure 7B:
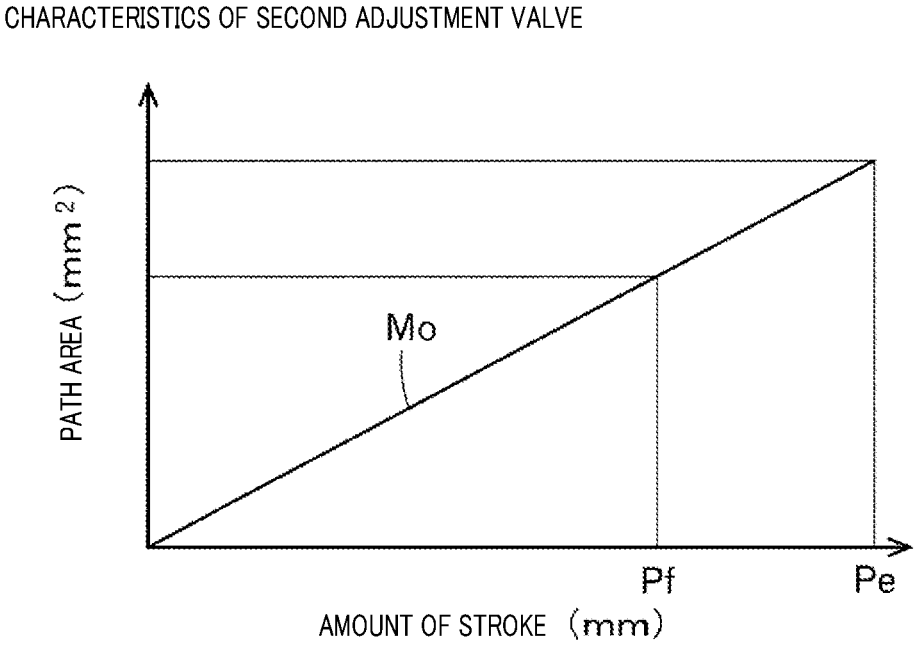

FIGS. 7A and 7B illustrate the operation forms of adjustment valves 13 and 20 in the second mode. FIG. 7A illustrates the operation form of first adjustment valve 13. FIG. 7B illustrates the operation form of second adjustment valve 20.

In the "second mode", first adjustment valve 13 is actuated based only on an operation of the swivel lever 8*i*, and second adjustment valve 20 is actuated based only on an operation of brake pedal 8*j*, When brake pedal 8*j* is not pressed in the "second mode", the spool included in second adjustment valve 20 is controlled to be always at the maximum sliding position (position Pe where the amount of stroke is the maximum).

When the operator performs an operation of tilting swivel lever 8*i* in a state where the "second mode" is selected, controller 35 recognizes the amount of operation of swivel lever 8*i*. Controller 35 then controls first adjustment valve 13 according to the amount of operation. Specifically, the spool is slid according to the amount of operation (position Pa→position Pb). Accordingly, the path area is increased, and meter in-flow rate Mi is increased. Unlike in the "first mode", in the "second mode", second adjustment valve 20 is not controlled. Instead, when brake pedal 8*j* is operated, controller 35 recognizes the amount of operation and controls second adjustment valve 20. Specifically, when brake pedal 8*j* is pressed, the spool is slid according to the amount of operation (position Pe→position Pf). Accordingly, the path area is reduced, and meter out-flow rate Mo is reduced. When pressing of brake pedal 8*j* is stopped, the spool tends to return to the original position (position Pf→position Pe). Accordingly, the path area is increased, and meter out-flow rate Mo is increased (the state returns to the original state).

On the contrary, when the operator performs an operation of raising swivel lever 8*i*, controller 35 recognizes the amount of operation of swivel lever 8*i*. Controller 35 then controls first adjustment valve 13 according to the amount of operation. Specifically, the spool is slid according to the amount of operation (position Pb→position Pa). Accordingly, the path area is reduced, and meter in-flow rate Mi is reduced. Unlike in the "first mode", in the "second mode", second adjustment valve 20 is not controlled. Instead, when brake pedal 8*j* is operated, controller 35 recognizes the amount of operation and controls second adjustment valve 20. Specifically, when brake pedal 8*j* is pressed, the spool is slid according to the amount of operation (position Pe→position Pf).

Accordingly, the path area is reduced, and meter out-flow rate Mo is reduced. When pressing of brake pedal 8*j* is stopped, the spool tends to return to the original position (position Pf→position Pe). Accordingly, the path area is increased, and meter out-flow rate Mo is increased (the state returns to the original state).

As described above, when the "second mode" is selected, first adjustment valve 13 increases the flow rate with increase in the amount of operation of the main operation tool (swivel lever 8*i*), and reduces the flow rate with reduction in the amount of operation of the main operation tool (swivel lever 8*i*). Meanwhile, second adjustment valve 20 reduces the flow rate with increase in the amount of operation of the sub-operation tool (brake pedal 8*j*), and increases the flow rate with reduction in the amount of operation of the sub-operation tool (brake pedal 8*j*). Consequently, when the "second mode" is selected, the braking force can be applied by, for example, reducing the flow rate at second adjustment valve 20 (meter out-flow rate Mo) with respect to the flow rate at first adjustment valve 13 (meter in-flow rate Mi), thereby allowing the maneuvering characteristics to be finely achieved.

Next, the "third mode" that is a third maneuvering form is described.

Figure 8A:
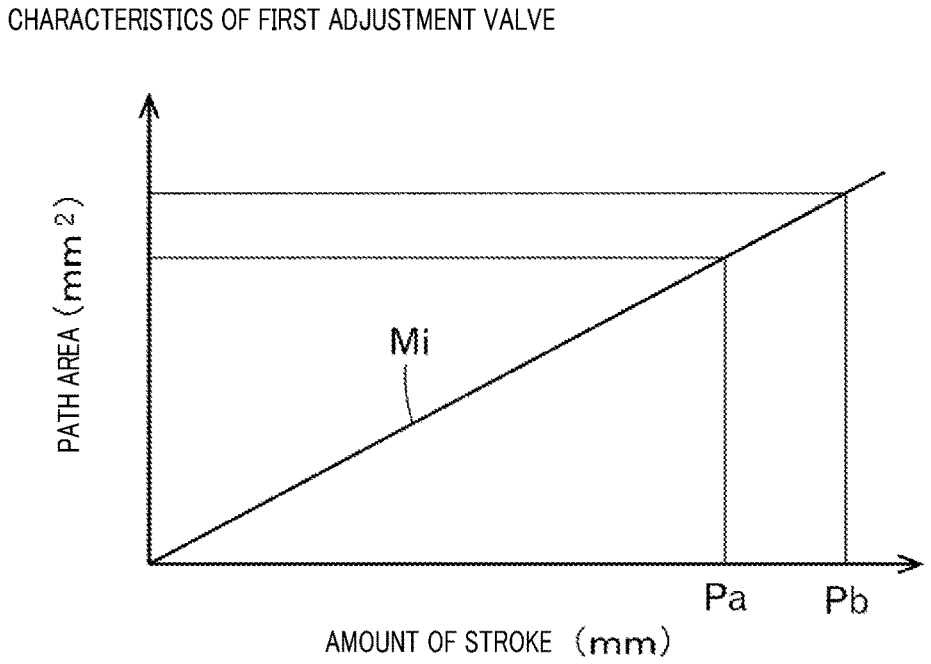
FIGS. 8A and 8B illustrate operation forms of adjustment valves in a third mode.
Figure 8B:
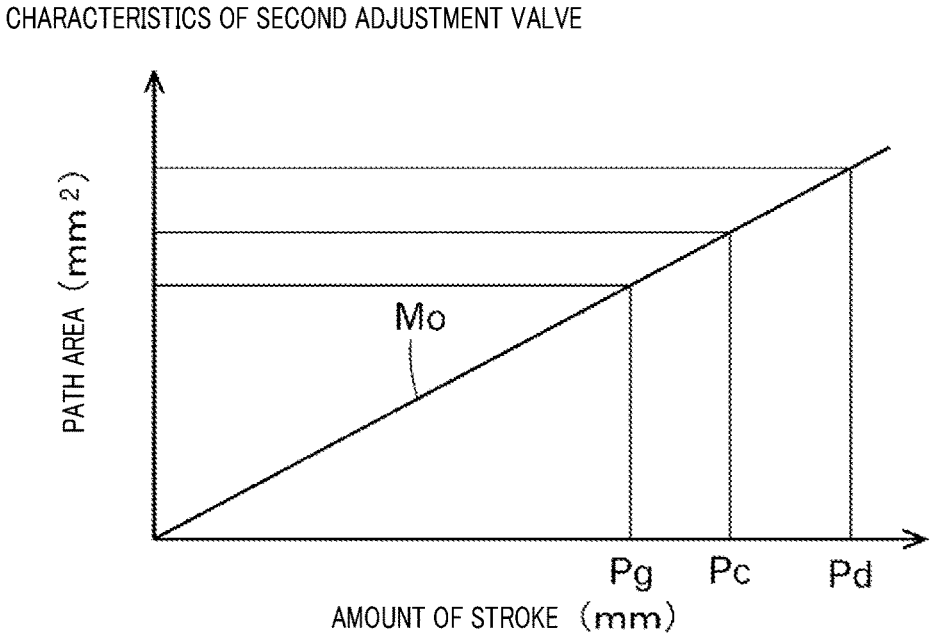

FIGS. 8A and 8B illustrate the operation forms of adjustment valves 13 and 20 in the third mode. FIG. 8A illustrates the operation form of first adjustment valve 13. FIG. 8B illustrates the operation form of second adjustment valve 20.

In the "third mode", first adjustment valve 13 is actuated based only on an operation of the swivel lever 8*i*, and second adjustment valve 20 is actuated based on an operation of swivel lever 8*i* while being also actuated based on an operation of brake pedal 8*j*.

When the operator performs an operation of tilting swivel lever 8*i* in a state where the "third mode" is selected, controller 35 recognizes the amount of operation of swivel lever 8*i*. Controller 35 then controls first adjustment valve 13 according to the amount of operation. Specifically the spool is slid according to the amount of operation (position Pa→position Pb). Accordingly, the path area is increased, and meter in-flow rate Mi is increased. At the same time, controller 35 also controls second adjustment valve 20 according to the amount of operation. Specifically, the spool is slid according to the amount of operation (position Pc→position Pd). Accordingly, the path area is increased, and meter out-flow rate Mo is increased. Here, when brake pedal 8*j* is operated, controller 35 recognizes the amount of operation and controls second adjustment valve 20. Specifically, when brake pedal 8*j* is pressed, the spool is slid according to the amount of operation (position Pd→position Pg). Accordingly, the path area is reduced, and meter out-flow rate Mo is reduced. When pressing of brake pedal 8*j* is stopped, the spool tends to return to the original position (position Pg→position Pd). Accordingly, the path area is increased, and meter out-flow rate Mo is increased (the state returns to the original state).

On the contrary, when the operator performs an operation of raising swivel lever 8*i*, controller 35 recognizes the amount of operation of swivel lever 8*i*. Controller 35 then controls first adjustment valve 13 according to the amount of operation. Specifically, the spool is slid according to the amount of operation (position Pb→position Pa). Accordingly, the path area is reduced, and meter in-flow rate Mi is reduced. At the same time, controller 35 also controls second adjustment valve 20 according to the amount of operation. Specifically, the spool is slid according to the amount of operation (position Pd→position Pc). Accordingly, the path area is reduced, and meter out-flow rate Mo is reduced. Here, when brake pedal 8*j* is operated, controller 35 recognizes the amount of operation and controls second adjustment valve 20. Specifically, when brake pedal 8*j* is pressed, the spool is slid according to the amount of operation (position Pc→position Pg). Accordingly, the path area is reduced, and meter out-flow rate Mo is reduced. When pressing of brake pedal 8*j* is stopped, the spool tends to return to the original position (position Pg→position Pc). Accordingly, the path area is increased, and meter out-flow rate Mo is increased (the state returns to the original state).

As described above, when the "third mode" is selected, first adjustment valve 13 and second adjustment valve 20 increase the respective flow rates with increase in the amount of operation of the main operation tool (swivel lever 8*i*), and reduce the respective flow rates with reduction in the amount of operation of the main operation tool (swivel lever 8*i*). Second adjustment valve 20 reduces the flow rate to be less than the flow rate according to the amount of operation of the main operation tool (swivel lever 8*i*) with increase in the amount of operation of the sub-operation tool (brake pedal 8*j*), and increases the flow rate to the flow rate according to the amount of operation of the main operation tool (swivel lever 8*i*) with reduction in the amount of operation of the sub-operation tool (brake pedal 8*j*). Consequently, when the "third mode" is selected, even though the conventional maneuvering form performing the swivel operation through the single operation tool (swivel lever 8*i*) is still adopted, the braking force can be applied by, for example, reducing the flow rate at second adjustment valve 20 (meter out-flow rate Mo) with respect to the flow rate at first adjustment valve 13 (meter in-flow rate Mi), thereby allowing fine maneuvering characteristics to be achieved.

As described above, according to this crane 1, first adjustment valve 13 can freely adjust the flow rate of the hydraulic fluid to be delivered to hydraulic motor 19, and second adjustment valve 20 can freely adjust the flow rate of the hydraulic fluid returned from hydraulic motor 19. This crane 1 can select any one of first to third modes. In the "first mode", first adjustment valve 13 and second adjustment valve 20 are actuated based only on an operation of the main operation tool (swivel lever 8*i*). In the "second mode", first adjustment valve 13 is actuated based only on an operation of the main operation tool (swivel lever 8*i*), and second adjustment valve 20 is actuated based only on an operation of the sub-operation tool (brake pedal 8*j*). In the "third mode", first adjustment valve 13 is actuated based only on an operation of the main operation tool (swivel lever 8*i*), and second adjustment valve 20 is actuated based on an operation of the main operation tool (swivel lever 8*i*) while being also actuated based on an operation of the sub-operation tool (brake pedal 8*j*). Such crane 1 can select one maneuvering form from among the three maneuvering forms including the conventional maneuvering form. When the "second mode" or "third mode" is selected, fine maneuvering characteristics can be achieved.

The present invention can be used for a crane.

REFERENCE SIGNS LIST

1 Crane
3 Swivel body
7 Boom
8 Cabin
8*i* Swivel lever (main operation tool)
8*j* Brake pedal (sub-operation tool)
11 Hydraulic pump
13 First adjustment valve
15 Direction switching valve
19 Hydraulic motor
20 Second adjustment valve
31 Position sensor
33 Position sensor
35 Controller
M Swivel apparatus
Mi Meter in-flow rate
Mo Meter out-flow rate

The invention claimed is:

1. A crane, comprising:
a first adjustment valve;
a second adjustment valve; and
a hydraulic motor used for a swivel operation,
the first adjustment valve being freely adjustable in a flow rate of hydraulic fluid to be delivered to the hydraulic motor,
the second adjustment valve being freely adjustable in a flow rate of hydraulic fluid returned from the hydraulic motor,
the crane further comprising:
a controller capable of controlling the first adjustment valve and the second adjustment valve;
a main operation tool allowing for inputting an instruction pertaining to the swivel operation into the controller; and
a sub-operation tool allowing for inputting an instruction pertaining to the swivel operation into the controller,
wherein the crane allows for selecting any one of:
a first mode, in which the first adjustment valve and the second adjustment valve are actuated based only on an operation of the main operation tool;
a second mode, in which the first adjustment valve is actuated based only on the operation of the main operation tool, and the second adjustment valve is actuated based only on an operation of the sub-operation tool; and a third mode, in which the first adjustment valve is actuated based only on the operation of the main operation tool, and the second adjustment valve is actuated based on the operation of the main operation tool while being also actuated based on the operation of the sub-operation tool.

2. The crane according to claim 1, wherein when the first mode is selected, the first adjustment valve and the second adjustment valve increase the respective flow rates with increase in an amount of operation of the main operation tool, and reduce the respective flow rates with reduction in the amount of operation of the main operation tool.

3. The crane according to claim 1, wherein when the second mode is selected, the first adjustment valve increases the flow rate with increase in an amount of operation of the main operation tool, and reduces the flow rate with reduction in the amount of operation of the main operation tool, and the second adjustment valve reduces the flow rate with increase in an amount of operation of the sub-operation tool, and increases the flow rate with reduction in the amount of operation of the sub-operation tool.

4. The crane according to claim 1, wherein when the third mode is selected, the first adjustment valve and the second adjustment valve increase the respective flow rates with increase in an amount of operation of the main operation tool, and reduce the respective flow rates with reduction in the amount of operation of the main operation tool, and the second adjustment valve reduces the flow rate to be a lesser flow rate than the flow rate according to the amount of operation of the main operation tool with increase in an amount of operation of the sub-operation tool, and increases the lesser flow rate to the flow rate according to the amount of operation of the main operation tool with reduction in the amount of operation of the sub-operation tool.

* * * * *